US006858855B2

(12) United States Patent
Chen

(10) Patent No.: US 6,858,855 B2
(45) Date of Patent: Feb. 22, 2005

(54) RADIATION SHIELD SHEET

(75) Inventor: Chang Shu Chen, Taipei (TW)

(73) Assignee: Ever Gonanza Co. Ltd., Taipei (TW)

( * ) Notice: Subject to any disclaimer, the term of this patent is extended or adjusted under 35 U.S.C. 154(b) by 0 days.

(21) Appl. No.: 10/329,267

(22) Filed: Dec. 23, 2002

(65) Prior Publication Data

US 2004/0119032 A1 Jun. 24, 2004

(51) Int. Cl.[7] ..... G21C 11/00; G21F 3/02; G21F 5/00; G21F 5/02

(52) U.S. Cl. ..... 250/515.1; 250/506.1; 250/496.1; 250/498.1; 250/516.1; 250/519.1

(58) Field of Search ..... 250/515.1, 506.1, 250/496.1, 498.1, 516.1, 519.1; 252/478; 428/215; 361/22, 220; 343/841; 501/155

(56) References Cited

U.S. PATENT DOCUMENTS 3,622,432 A * 11/1971 McCluer et al. ..... 428/215
6,372,157 B1 * 4/2002 Krill et al. ..... 252/478
6,635,893 B2 * 10/2003 O'Kane et al. ..... 250/506.1
6,674,087 B2 * 1/2004 Cadwalader et al. ..... 250/515.1
6,697,248 B1 * 2/2004 Luch ..... 361/220
2002/0060300 A1 * 5/2002 O'kane et al. ..... 250/515.1
2002/0097189 A1 * 7/2002 Coloney ..... 343/841
2002/0148980 A1 * 10/2002 Cadwalader et al. ..... 250/515.1
2002/0165082 A1 * 11/2002 Singh et al. ..... 501/155

* cited by examiner

*Primary Examiner*—Nikita Wells
*Assistant Examiner*—Mary El-Shammaa
(74) *Attorney, Agent, or Firm*—Raymond Y. Chan; David and Raymond

(57) ABSTRACT

A radiation shield sheet includes a raw utilizing sheet, which includes a plurality of fibers and a plurality of matrixes reinforced together to define a predetermined crossed structure having a plurality of trapping meshes formed between the fibers and matrixes respectively, and a shielding layer, which is made by a predetermined amount of radiation inadmissible material capable of attenuating an intensity of a predetermined electromagnetic radiation, coated on an exposure surface of the raw utilizing sheet, wherein a portion of the shielding layer is captured in the trapping meshes so as to securely bond the radiation shielding layer on the raw utilizing sheet.

18 Claims, 7 Drawing Sheets

RADIATION SHIELD SHEET

BACKGROUND OF THE PRESENT INVENTION

1. Field of Invention

The present invention relates to a radiation protective material, and more particularly to a radiation shield sheet for blocking radiation from passing therethrough.

2. Description of Related Arts

It is well known that, nowadays, most people, especially those in developed countries, have gained the knowledge and are aware of that radiation can in itself bring disastrously and destructively harmful effect to human beings because of its extremely high penetrating ability and power carried along. The huge penetrating power of radiation means it can penetrate the cells of all human beings and virtually all standard materials by which people utilize to shield themselves in various circumstances, such as concrete for building houses. The immense amount of power carried by radiation means that it possesses the disastrously destructive ability to 'pump' extremely large amount of energy to virtually everything in a split-second.

In reality, proper control of radioactive materials, in a contrary following from the above description of the nature of radiation, actually helps in boosting up the living standard of human beings. One of the well-known examples is X-ray diagnosis. Others are cancer treating, laser machining, retrieving information in compact discs etc. Thus, the actual story is radiation of various degrees have various influences in a variety of circumstances. Their influences are highly context-specific, though radiation shields are still indispensable in protecting people who, for some reason, expose themselves to radiation at various levels.

Conventional radiation shield involves at least a layer of radiation-inadmissible material, lead in relation to gamma radiation for example, which is coated on other materials or structures such as walls or fabrics which are to be exposed to radiation of various kinds. By the virtue of these arrangements, the materials or structures involved are capable of acting as a shelter to a particular kind of radiation wherein a person can be able to utilize them to attenuate the amount of radiation reaching them, so as to reduce the potential harmful effect generated within his/her body.

Yet the conventional radiation shields lack either sufficient flexibility or acceptable durability. This proposition can be shown on the grounds that, conventionally, the radiation-inadmissible materials which are usually coated on a relatively smooth object, such as walls or fabrics, are thick and heavy to sufficiently affect the normal operation of the objects being coated. As a convention, one needs to compromise that in order to provide sufficient radiation shielding from the radiation-inadmissible materials concerned, it must be coated on targeted objects with considerable thickness which further induces considerable weights to the end product. Inflexibility thus becomes one of the pressing problems revolving around conventional radiation shields. This factor is of overriding significance with one who comes to deal with fabric radiation shield, for the comfort and the normal operations of the fabric are extremely vulnerable to increased thickness and weight.

Furthermore, the binding between the radiation-inadmissible material and the object to be coated is often unsatisfactory. As a matter of fact, it is known technically that, for textile materials, the purity of the metal coating provided on the textile material by the conventional non-electrolytical plating process is unsatisfactory and that the crystallinity of the plated metal coating is insufficient, and therefore, the electroconductivity of the metallized textile material is unsatisfactory.

These all lead to a need for developing a more durable, effective, and flexible radiation shielding in order to provide effective protection of mainly electromagnetic radiation to people who frequently encounter such kind of radiation.

SUMMARY OF THE PRESENT INVENTION

A main object of the present invention is to provide a radiation shield sheet and a producing method thereof, which comprises a fiber reinforced sheet having at least an exposure surface fully coated with a predetermined radiation-inadmissible materials to form a radiation shield layer that is evenly supported and reinforced integrally so as to effectively and uniformly shield electromagnetic radiation among the radiation shield sheet without inducing significant thickness and weight thereof as compared with conventional arts.

Another object of the present invention is to provide a radiation shield sheet and a producing method thereof, wherein the radiation-inadmissible material is not only coated on the fiber reinforced sheet, but also diffused and bonded into a plurality of voids formed between a plurality of fibers and matrixes of the fiber reinforced sheet respectively, so as to minimize the thickness and maximize the bonding of the radiation-inadmissible material for a given radiation shielding performance.

Another object of the present invention is to provide a radiation shield sheet and a producing method thereof, which is capable of being constructed to a radiation protection accessory of various forms, such as radiation shielding clothes, and radiation shielding box which is made of fiber reinforced composites.

Another object of the present invention is to provide a radiation sheet shield which neither involve expensive components in building up the radiation shield sheet as compared with related arts, nor complicated procedures and equipments in producing the radiation sheet shield, so as to minimize the manufacturing and other related expenses thereof.

Accordingly, in order to accomplish the above objects, the present invention provides a radiation shield sheet, comprising:

a raw utilizing sheet, which comprises a plurality of fibers and a plurality of matrixes reinforced together to define a predetermined net structure having a plurality of trapping meshes formed between said fibers and matrixes respectively; and a shielding layer, which is made by predetermined amount of radiation inadmissible material capable of attenuating an intensity of a predetermined electromagnetic radiation, coated on an exposure surface of said raw utilizing sheet, wherein a portion of said shielding layer is captured in said trapping meshes so as to securely bond said radiation shielding layer on said raw utilizing sheet.

DETAILED DESCRIPTION OF THE PREFERRED EMBODIMENT

Referring to FIGS. 1 to 7 of the drawings, a preferred embodiment of the present invention illustrates a radiation shield sheet 1 which comprises a raw utilizing sheet 10 and a shielding layer 20 securely coated thereon to form an integral sheet of synthetic material.

Figure 1:
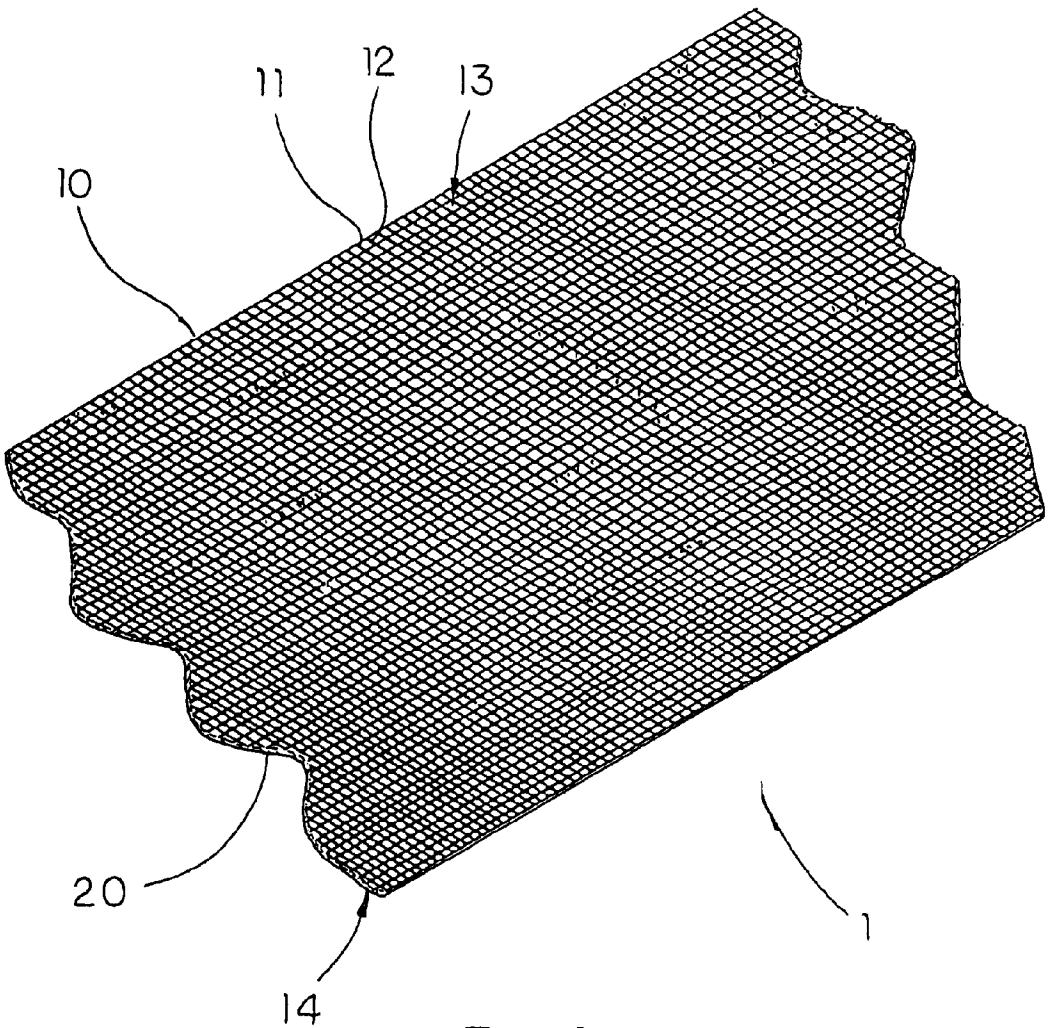
FIG. 1 is a perspective view of a radiation shield sheet according to a preferred embodiment of the present invention.
Figure 2:
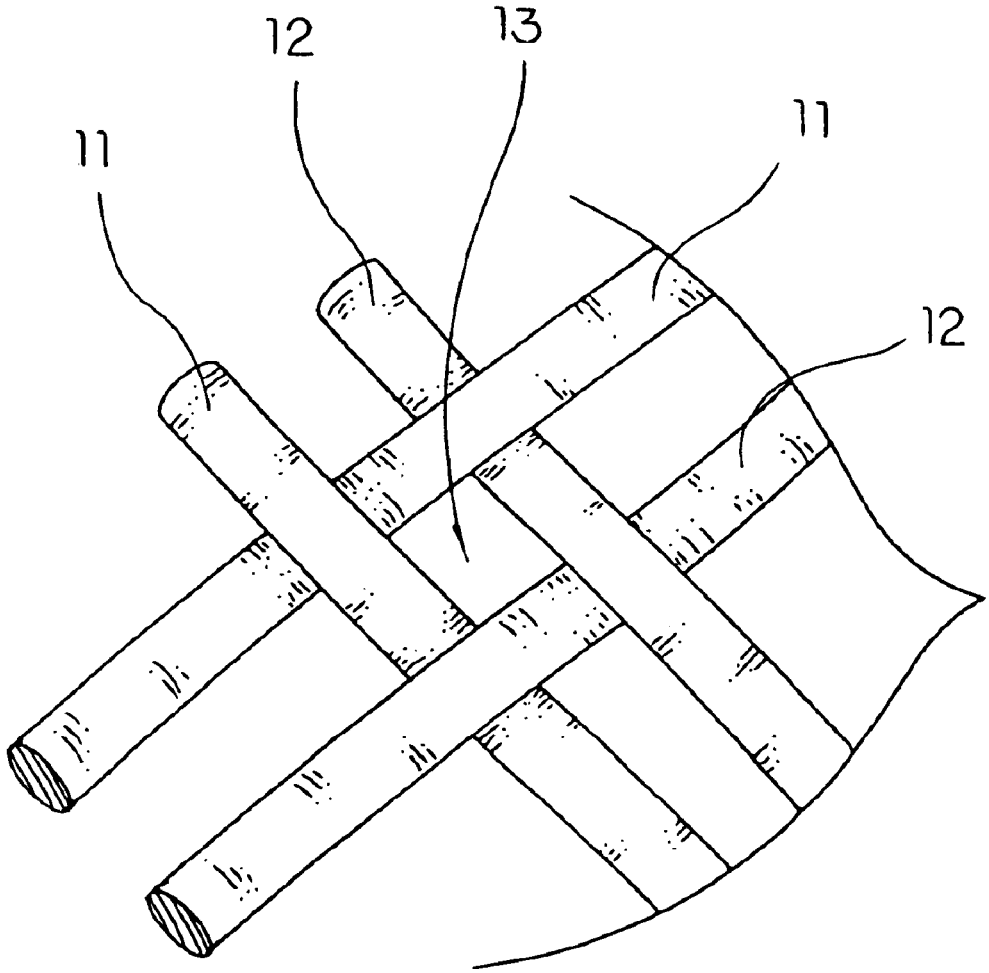
FIG. 2 is a schematic view of the radiation shield sheet according to the above preferred embodiment of the present invention, illustrating the fiber reinforced structure of the raw utilizing sheet.
Figure 3:
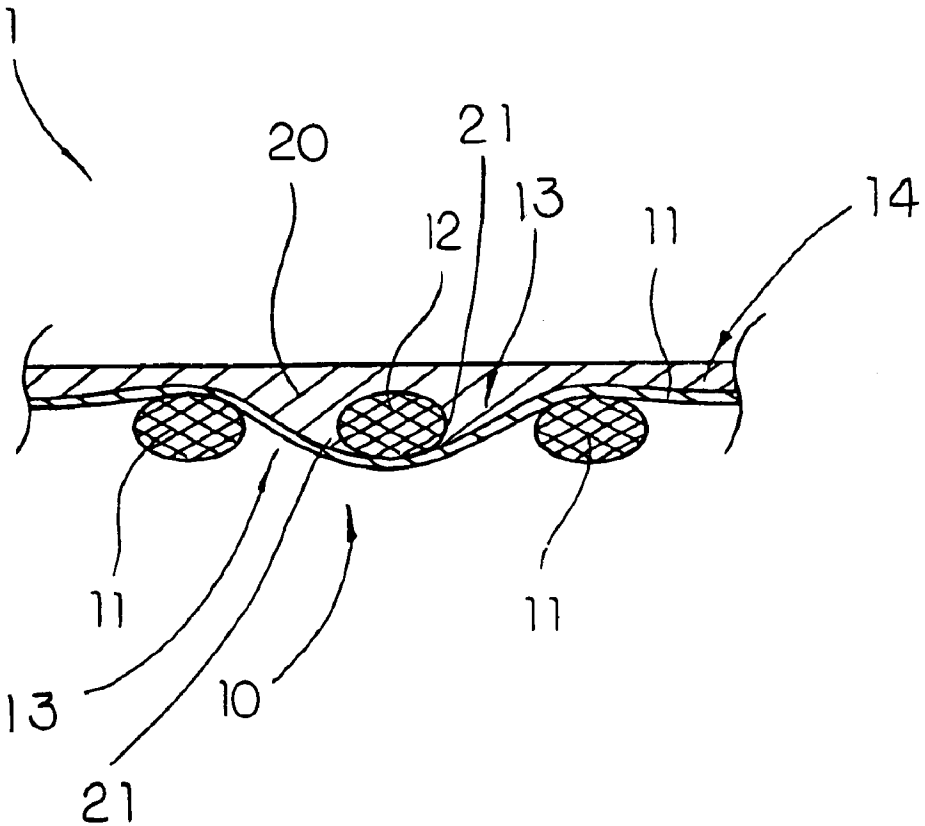
FIG. 3 is a sectional side view of the radiation shield sheet according to the above preferred embodiment of the present invention, illustrating the bonding structure of the shielding layer in relation to the raw utilizing sheet.

Referring to FIGS. 1 to 2 of the drawings, the raw utilizing sheet 10 comprises a plurality of fibers 11 and a plurality of matrixes 12 woven with each other in a predetermined net structure to define a fiber reinforced structure wherein a plurality of trapping meshes 13 is formed between the fibers 11 and the matrixes 12 respectively. According to the preferred embodiment of the present invention, the raw utilizing sheet 10 is embodied as a kind of fabric that is adapted to be manufactured into radiation protective accessory such as radiation shielding clothes. Accordingly, such radiation shielding clothes provide radiation shielding for those frequently encounter radiation. The raw utilizing sheet 10 further has at least an exposure surface 14 provided on one side which is adapted to be exposed to electromagnetic radiation. Certainly, both sides of the raw utilizing sheet 10 can be made to form exposure surfaces when both sides are coated with the shielding layer 20, so that each of the surfaces can be exposed to the radiation and provide radiation shielding performance.

The shielding layer 20 comprises a predetermined amount of radiation inadmissible material, such as lead at a particular state for electromagnetic radiation, fully and evenly coated on the exposure surface 14 of the raw utilizing sheet 10 in such a manner that it is capable of attenuating electromagnetic radiation impinges thereon. In other words, upon impinging on the exposure surface 14, a predetermined amount of radiation power will be attenuated by the shielding layer 20, depending on the material parameters of the shielding layer 20, and that the amount of radiation passing through the radiation shield sheet 1 of the present invention should be at least of safety standard.

The shielding layer 20 is coated on the exposure surface 14 of the raw utilizing sheet 10 in such a manner that a portion of the radiation inadmissible material is extended and captured to bond into the trapping meshes 13 constructed by the interweaving of the fibers 11 and the matrixes 12 to form a plurality of holding roots 21 of the shielding layer 20, therefore the cross-netted fibers 11 and matrixes 12 substantially and evenly support and reinforce the radiation inadmissible material to form a layer of radiation inadmissible material integrally attached to the raw utilizing sheet. On skilled in the art should appreciate that the ability of the radiation attenuation of the shielding layer 20, in mathematics terms, is a function of its thickness, thus, for a given radiation attenuation, the thickness of the shielding layer 20 can be maximized as the shielding layer 20 is partially incorporated with the raw utilizing sheet 10. Generally, a thicker raw utilizing sheet 10 having deeper trapping meshes 13 may hold more radiation inadmissible material therein to support a thicker shielding layer 20 since the holding roots 21 can be extended deeper to hold on the adjacent fibers 11 and matrixes 12.

As an illustration, for unit surface area, if a coating of the shielding layer 20 of thickness h is required to attenuate a certain desirable amount of radiation, and suppose the thickness of each of the trapping meshes 13 is h', then, according to the first preferred embodiment of the present invention, the required thickness of the shielding layer 20 in order to achieve the same amount of radiation attenuation is only h–h'. Accordingly, the thickness of the shielding layer 20 for a given radiation attenuation can be minimized. And, as a result, the radiation shielding clothes, which are made by the radiation shield sheet 1 of the present invention, can be of maximum comfort as compared with conventional arts.

It is worth mentioning that, as an alternative, the matrixes 11 of the raw utilizing sheet 10 can form as a plurality of reinforcing fibers which are made of different materials from the fibers 12 mentioned above to achieve desirable performance in textile's perspective.

It is of primary importance to bear in mind that the radiation shield sheet 10 of the present invention is to provide a construction element for radiation shielding clothing. To avoid interruption of the shielding effect in the area of the joint seams or pockets, special attention should be paid to those areas. For example, the joint seams should be turned up into each other and sewed together by at least two seams with a sewing yarn. In addition, pockets should not be inserted into but put on the fabric so as to prevent interruptions of the shielding effect.

Figure 4:
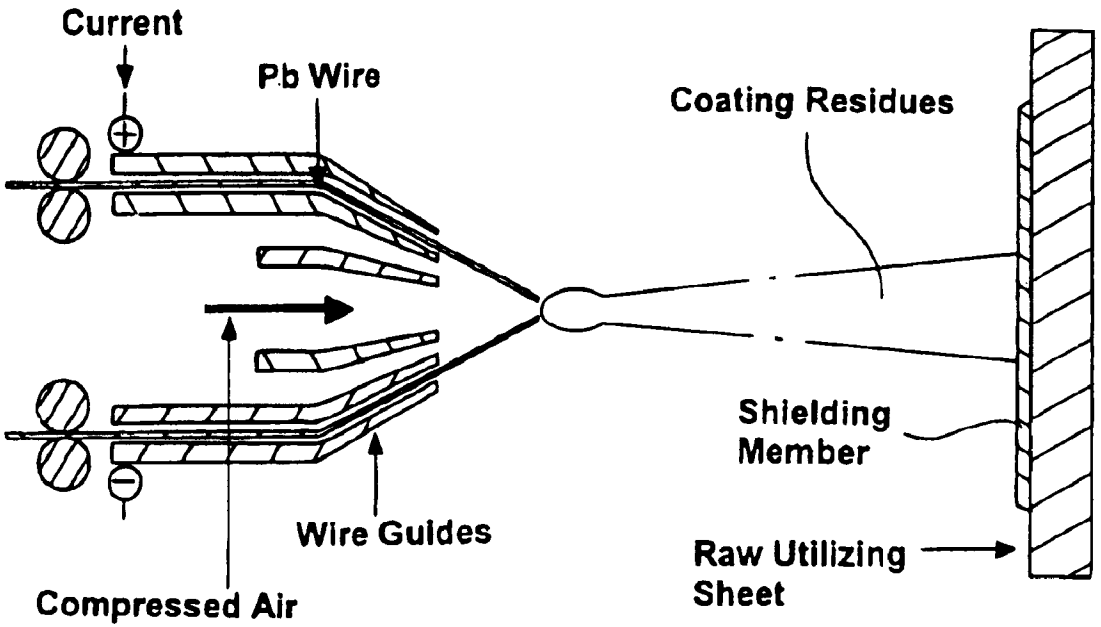
FIG. 4 is a schematic diagram of the production process of the radiation shield sheet according to the above preferred embodiment of the present invention.

Referring to FIG. 4 of the drawings, the manufacturing process of the radiation shield sheet 1 according to the first preferred embodiment of the present invention is schematically illustrated. According to the preferred embodiment, the method of producing the radiation shield sheet 1 comprises the steps of:

(a) providing a piece of the raw utilizing sheet 10;

(b) providing a predetermined amount of radiation inadmissible materials at a predetermined form of existence;

(c) raising the temperature of the radiation inadmissible materials to an extent of melting the radiation inadmissible materials so as to form a predetermined amount of coating residues; and (d) applying the coating residues towards the exposure surface of the raw utilizing sheet 10" so as to coat the exposure surface with the coating residues for forming the shielding layer 20.

The step (b) further comprises the steps of:

(b1) providing a pair of wires which are made of the predetermined radiation inadmissible materials, wherein two respective melting ends of the two wires are arranged to position very close to each other at a predetermined arcing distance.

In step (b1) above, the radiation admissible materials is preferably lead (Pb) as mentioned above. According to the first preferred embodiment of the present invention, the step (c) mentioned above further comprises the step of:

(c1) applying high potential difference between the two wires so as to produce short circuit between the two melting ends of the two wires for generating high local temperature at the two melting ends to melt the two melting ends.

Furthermore, the step (d) further comprises the step of:

(d1) applying compressed gas to the melting ends of the two wires for atomizing and accelerating the coating residues towards the exposure surface of the raw utilizing sheet 10 so as to coat the exposure surface with the coating residues to form the shielding layer 20.

Note that in step (c1), when an extremely high potential difference is applied between the two wires, preferably a potential difference 40V–50V, a short circuit will be produced at the two closely positioned but slightly separated melting ends of the two wires. As a result, an electric arc will be formed between the two melting ends of the two wires.

In step (d1), the compressed gas can be normal compressed air or inert gas which does not chemically react with the radiation inadmissible materials, preferably lead. The compressed gas is used to atomize and accelerate the coating residues towards the raw utilizing sheet 10 so that the radiation inadmissible material is capable of being coated on the exposure surface of the raw utilizing sheet 10 to form the shielding layer 20. According to the first preferred embodiment, the pressure of the compressed air is designed to be 4–10 bars for preferably producing the radiation shield sheet 1 of the present invention.

It is worth mentioning that one of the advantages of the above-mentioned production method is that, instead of only lead (Pb) wires, two different wires can be used simultaneously to produce a pseudo alloy.

Equally remarkable is that in order to properly produce the radiation shield sheet 1 of the present invention, any wax or oil on the raw utilizing sheet 10 should be eliminated before commencing step (d), and preferably prior to step (a). Should there are any wax or oil present on the raw utilizing sheet 10 and step (d) is still carried out, the coating performance which follows will severely be deteriorated as compared with wax-free or oil-free raw utilizing sheet 10.

Figure 5:
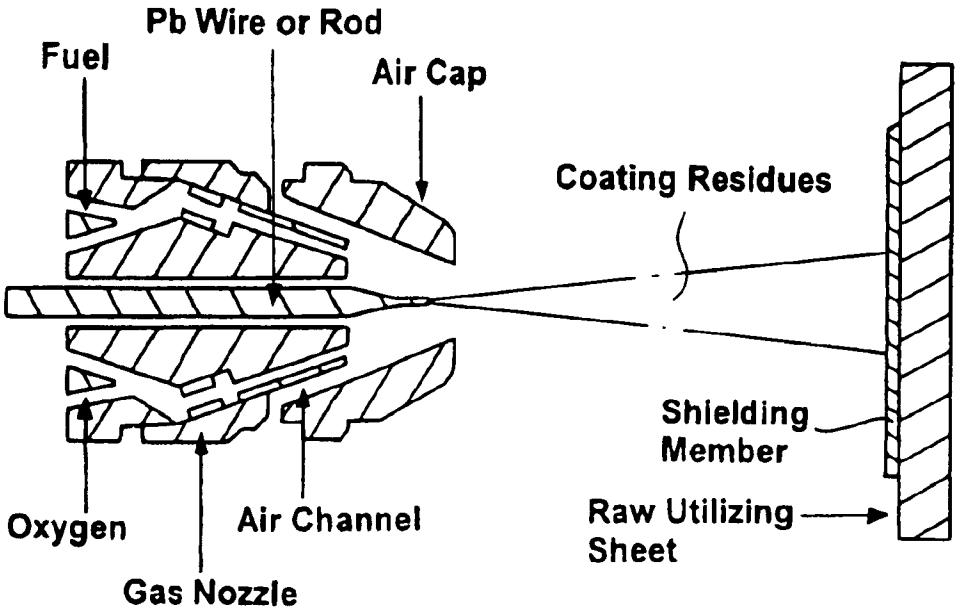
FIG. 5 is a schematic diagram of the production process of the radiation shield sheet according to a first alternative mode of the preferred embodiment of the present invention.

Referring to FIG. 5 of the drawings, an alternative mode of the radiation shield sheet 1' according to the preferred embodiment of the present invention is illustrated. The first alternative mode is pretty much the same as the preferred embodiment, except the production method. According to the first alternative mode, the step (b') of the production method comprises the step of:

(b1') providing a wire, having a melting end, which is made of the predetermined radiation inadmissible materials.

On the other hand, the step (c') comprises the steps of:

(c1') providing a predetermined amount of air and fuel mixed together in the vicinity of the melting end of the wire; and (c2') igniting the air-fuel mixture to generate combustion in the vicinity of the melting end of the wire so as to sharply increase the temperature thereof for melting the melting end to produce the coating residues.

In step (c1'), the fuel can be regular combustible fuel, such as acetylene, wherein the air and the fuel should be mixed at an optimal air-fuel ratio—which should be derived from simple classical thermodynamics theory—in order to achieve the most efficient combustion.

In step (c2'), the air-fuel mixture is ignited in order to generate combustion. Once the mixture is combusted, a large amount of heat will be generated so as to sharply raise the local temperature of the melting end of the wire. Thus, coating residues is formed as the melting end melts. Upon proper control of the combustion process, the temperature can be raised as high as 3000° C.

Lastly, the step (d') comprises the step of:

(d1') applying compressed gas to the melting end of the wire for atomizing and accelerating the coating residues towards the exposure surface of the raw utilizing sheet 10' so as to coat the exposure surface with the coating residues for forming the shielding layer 20'.

One remark about the production process, the shielding layer 20' thus made following the first alternative mode of production process should contain greater amount of oxides as compared with the production process of the first preferred embodiment. As a result, the present first alternative mode should be used when a rougher and a less expensive surface finish are desired, or a smoother and more expensive surface finish is not required for a particular purpose.

In addition, in step (b1'), instead of utilizing a lead wire, a rod which is made of lead may also be used to produce the coating residues in step (c').

Figure 6:
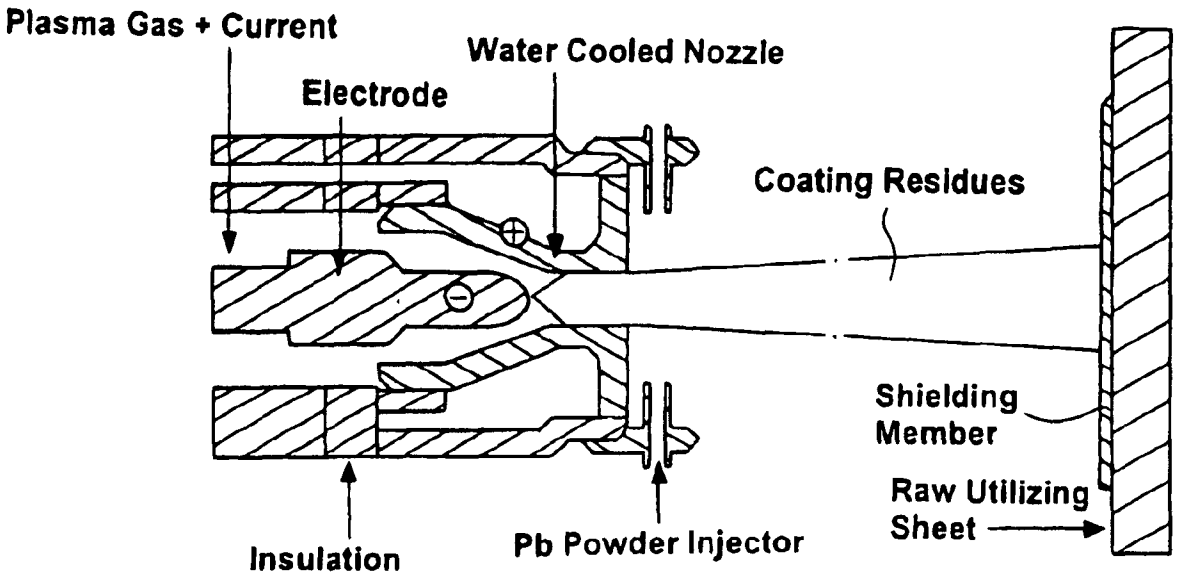
FIG. 6 is a schematic diagram of the production process of the radiation shield sheet according to a second alternative mode of the preferred embodiment of the present invention.

Referring to FIG. 6 of the drawings, a second alternative mode of the radiation shield sheet 1" according to the above first preferred embodiment of the present invention is illustrated. The second alternative mode, as in the case of the first alternative mode, covers a modification of the radiation shield sheet 1" of the production method. According to the second alternative mode, the step (b") comprises the step of:

(b1") providing a predetermined amount of powdered radiation inadmissible materials which is to be melted to form the coating residues.

Since the radiation inadmissible material is preferably lead (Pb), therefore, a predetermined amount of lead powder should be prepared.

The step (c") further comprises the steps of:

(c1") providing a plasma of a predetermined inert gas, and arranging the plasma to be flowed between an electrode and a nozzle at a predetermined flow rate; and (c2") applying a predetermined amount of potential difference between the electrode and the nozzle so as transfer a large amount of energy to the plasma to ionize atoms of the plasma and thus generate a large amount of heat and an immense expansion of the plasma.

In step (c") above, the element used to create the plasma is preferably argon gas. As illustrated below, the argon gas will be utilized as a medium for melting the radiation inadmissible materials.

Accordingly, the step (d") further comprises the steps of:

(d1") injecting a predetermined amount of powder of the radiation inadmissible materials to the expanding plasma such that the radiation inadmissible material in its powdered form is melted by the high temperature plasma to form the coating residues; and (d2") injecting the coating residues towards the exposure surface of the raw utilizing sheet 10" to form the shielding layer 20".

It is worth noting that the temperature for melting substantially all lead powder should be in the range of around 8000° C. to 15000° C., which represents a current of 800A to 1000A should be passed through the electrode and the nozzle. It is worth mentioning that in order to further enhance the melting ability of the plasma and reduce the energy used in heating the radiation inadmissible materials, a second gas may be injected into the plasma, which is preferably hydrogen.

Figure 7:
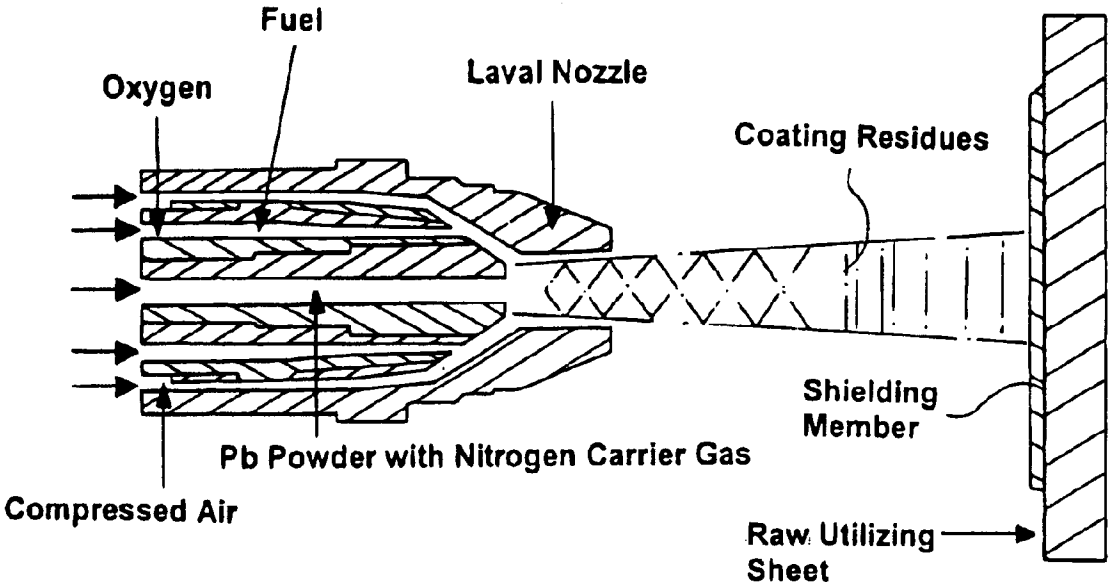
FIG. 7 is a schematic diagram of the production process of the radiation shield sheet according to a third alternative mode of the preferred embodiment of the present invention.

Referring to FIG. 7 of the drawings, a third alternative mode of the radiation shield sheet 1''' according to the above first preferred embodiment of the present invention is illustrated. The second alternative mode, as in the case of the first alternative mode, covers a modification of the radiation shield sheet 1''' of the production method. According to the third alternative mode, step (b''') comprises a step of:

(b1''') providing a predetermined amount of radiation inadmissible material in powdered form.

That is to say, lead powder is required at this stage.

Furthermore, step (c''') comprises the steps of:

(c1''') providing a predetermined amount of carrier gas, and arranging the gas to be mixed with the powdered radiation inadmissible material in a combustion chamber;

(c2''') providing a predetermined a mount of air and fuel mixed together and directing the mixture to the combustion chamber to mix with the carrier gas which is mixed with the radiation inadmissible material; and (c3''') igniting the air-fuel mixture and the carrier gas to generate combustion in the combustion chamber so as to sharply increase the temperature of the powdered radiation inadmissible material to melt the radiation inadmissible material to produce the coating residues.

Finally, the step (d''') comprises a step of:

(d1''') passing compressed gas to the coating residues for applying the coating residues to the exposure surface of the raw utilizing sheet 10''' so as to generate the shielding layer 20''' thereon.

It is worth mentioning that following the preceding procedures, the coating residues will impinges onto the raw utilizing sheet 10''' at extremely high velocity, which is estimated to reach supersonic velocity, resulting in an extremely good surface finish with insignificant oxides content for the shielding layer 20'''. This reason of low oxides content for the method shown in the third alternative mode is that the radiation inadmissible material is of powdered form, and as a result, complete combustion of the radiation inadmissible material can be easily achieved with increased combustion surface area. All these leading to good surface finish of the resulting shielding layer 20'''.

From the forgoing description and analysis of the present invention, one skilled in the arts should appreciate that the objects of the present invention as laid down at the beginning of this specification can be substantially accomplished.

What is claimed is:

1. A radiation shield sheet, comprising:

a raw utilizing sheet having a net structure defining a plurality of trapping meshes therethrough, wherein said raw utilizing sheet comprises a plurality of fibers and a plurality of matrixes reinforced together to define a fiber reinforced structure that forms said trapping meshes between said fibers and said matrixes respectively; and a shielding layer, which comprises a predetermined amount of radiation inadmissible material capable of attenuating an intensity of a predetermined amount of radiation, being fully and evenly coated on at least an exposure surface of said raw utilizing sheet, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer, wherein said radiation inadmissible material is lead which is capable of attenuating a predetermined amount of electromagnetic radiation impinging thereon;

wherein said radiation shield sheet is produced by a method which comprises the steps of:

(a) providing a piece of said raw utilizing sheet;

(b) providing a predetermined amount of said radiation inadmissible materials at a predetermined form of existence, wherein said step (b) comprises a step of providing a pair of wires which are made of said predetermined radiation inadmissible materials, wherein two respective melting ends of said two wires are arranged to position very close to each other at a predetermined arcing distance;

(c) raising the temperature of said radiation inadmissible materials to an extent of melting said radiation inadmissible materials so as to form a predetermined amount of coating residues; and (d) applying said coating residues towards said exposure surface of said raw utilizing sheet so as to coat said exposure surface with said coating residues for forming said shielding layer.

2. The radiation shield sheet, as recited in claim 1, wherein said step (c) of said production method comprises a step of applying a high potential difference between the said wires so as to produce short circuit between said two melting ends of said two wires for generating high local temperature at said two melting ends to melt said two melting ends.

3. The radiation shield sheet, as recited in claim 2, wherein said step (d) of said production method comprises a step of applying compressed gas to said melting ends of said two wires for atomizing and accelerating said coating residues towards said exposure surface of said raw utilizing sheet so as to coat said exposure surface with said coating residues to form said shielding layer.

4. A radiation shield sheet, comprising:

a raw utilizing sheet having a net structure defining a plurality of trapping meshes therethrough, wherein said raw utilizing sheet comprises a plurality of fibers and a plurality of matrixes reinforced together to define a fiber reinforced structure that forms said trapping meshes between said fibers and said matrixes respectively; and a shielding layer, which comprises a predetermined amount of radiation inadmissible material capable of attenuating an intensity of a predetermined amount of radiation, being fully and evenly coated on at least an exposure surface of said raw utilizing sheet, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer, wherein said radiation inadmissible material is lead which is capable of attenuating a predetermined amount of electromagnetic radiation impinging thereon;

wherein said radiation shield sheet is produced by a method which comprises the steps of:

(a) providing a piece of said raw utilizing sheet;

(b) providing a predetermined amount of said radiation inadmissible materials at a predetermined form of existence, wherein said step (b) comprises a step of providing a wire, having a melting end, which is made of said predetermined radiation inadmissible materials;

(c) raising the temperature of said radiation inadmissible materials to an extent of melting said radiation inadmissible materials so as to form a predetermined amount of coating residues, wherein said step (C) comprises the steps of:

(c1') providing a predetermined amount of air and fuel mixed together to form an air-fuel mixture in vicinity of said melting end of said wire; and (c2') igniting said air-fuel mixture to trigger combustion in vicinity of said melting end of said wire so as to sharply increase temperature thereof for melting said melting end to produce said coating residues; and (d) applying said coating residues towards said exposure surface of said raw utilizing sheet so as to coat said exposure surface with said coating residues for forming said shielding layer.

5. The radiation shield sheet, as recited in claim 4, wherein said step (d) of said production method comprises a step of applying compressed gas to said melting end of said wire for atomizing and accelerating said coating residues towards said exposure surface of said raw utilizing sheet so as to coat said exposure surface with said coating residues for forming said shielding layer.

6. A radiation shield sheet, comprising:

a raw utilizing sheet having a net structure defining a plurality of trapping meshes therethrough, wherein said raw utilizing sheet comprises a plurality of fibers and a plurality of matrixes reinforced together to define a fiber reinforced structure that forms said trapping meshes between said fibers and said matrixes respectively; and a shielding layer, which comprises a predetermined amount of radiation inadmissible material capable of attenuating an intensity of a predetermined amount of radiation, being fully and evenly coated on at least an exposure surface of said raw utilizing sheet, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer, wherein said radiation inadmissible material is lead which is capable of attenuating a predetermined amount of electromagnetic radiation impinging thereon;

wherein said radiation shield sheet is produced by a method which comprises the steps of:

(a) providing a piece of said raw utilizing sheet;

(b) providing a predetermined amount of said radiation inadmissible materials at a predetermined form of existence, wherein said step (b) comprises a step of providing a predetermined amount of said radiation inadmissible materials in powdered form;

(c) raising the temperature of said radiation inadmissible materials to an extent of melting said radiation inadmissible materials so as to form a predetermined amount of coating residues, wherein said step (c) comprises the steps of:

(c1") providing a plasma of a predetermined inert gas, and arranging said plasma to be flowed between an electrode and a nozzle at a predetermined flow rate; and (c2") applying a predetermined amount of potential difference between said electrode and said nozzle so as to transfer a large amount of energy to said plasma to ionize atoms of said plasma and thus generate a large amount of heat and an immense expansion of the plasma; and (d) applying said coating residues towards said exposure surface of said raw utilizing sheet so as to coat said exposure surface with said coating residues for forming said shielding layer.

7. The radiation shield sheet, as recited in claim 6, wherein said step (d) of said production method comprises the steps of:

(d1") injecting a predetermined amount of said powder of said radiation inadmissible materials to said expanding plasma such that said radiation inadmissible material in said powdered form is melted by said high temperature plasma to form said coating residues; and (d2") injecting said coating residues towards said exposure surface of said raw utilizing sheet to form said shielding layer.

8. A radiation shield sheet, comprising:

a raw utilizing sheet having a net structure defining a plurality of trapping meshes therethrough, wherein said raw utilizing sheet comprises a plurality of fibers and a plurality of matrixes reinforced together to define a fiber reinforced structure that forms said trapping meshes between said fibers and said matrixes respectively; and a shielding layer, which comprises a predetermined amount of radiation inadmissible material capable of attenuating an intensity of a predetermined amount of radiation, being fully and evenly coated on at least an exposure surface of said raw utilizing sheet, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer, wherein said radiation inadmissible material is lead which is capable of attenuating a predetermined amount of electromagnetic radiation impinging thereon;

wherein said radiation shield sheet is produced by a method which comprises the steps of:

(a) providing a piece of said raw utilizing sheet;

(b) providing a predetermined amount of said radiation inadmissible materials at a predetermined form of existence, wherein said step (b) comprises a step of providing a predetermined amount of said radiation inadmissible materials in powdered form;

(c) raising the temperature of said radiation inadmissible materials to an extent of melting said radiation inadmissible materials so as to form a predetermined amount of coating residues, wherein said step (c) of said production method comprises the steps of:

(c1") providing a predetermined amount of carrier gas, and arranging said carrier gas to be mixed with said powdered radiation inadmissible material in a combustion chamber;

(c2") providing a predetermined amount of air and fuel mixed together to form an air-fuel mixture and directing said mixture to said combustion chamber to mix with said carrier gas and said powdered radiation inadmissible material; and (c3") igniting said air-fuel mixture and said carrier gas to trigger combustion in said combustion chamber so as to sharply increase temperature of said powdered radiation inadmissible material which is mixed with said carrier gas to melt said radiation inadmissible material to produce said coating residues; and (d) applying said coating residues towards said exposure surface of said raw utilizing sheet so as to coat said exposure surface with said coating residues for forming said shielding layer.

9. The radiation shield sheet, as recited in claim 8, wherein said step (d) of said production method comprises a step of passing compressed gas to said coating residues for applying said coating residues to said exposure surface of said raw utilizing sheet so as to generate said shielding layer thereon.

10. A method of producing a radiation shield sheet, comprising the steps of:

(a) providing a piece of raw utilizing sheet which has a net structure defining a plurality of trapping meshes therethrough;

(b) providing a predetermined amount of radiation inadmissible materials at a predetermined form of existence, wherein said radiation inadmissible material capable of attenuating an intensity of a predetermined amount of radiation, wherein said step (b) comprises a step of providing a pair of wires which are made of said predetermined radiation inadmissible materials, wherein two respective melting ends of said two wires are arranged to position very close to each other at a predetermined arcing distance;

(c) raising the temperature of said radiation inadmissible materials to an extent of melting said radiation inadmissible materials so as to form a predetermined amount of coating residues; and (d) applying said coating residues towards an exposure surface of said raw utilizing sheet so as to coat said exposure surface with said coating residues to form a shielding layer, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer.

11. The method, as recited in claim 10, wherein the step (c) comprises a step of applying a high potential difference between the said wires so as to produce short circuit between said two melting ends of said two wires for generating high local temperature at said two melting ends to melt said two melting ends.

12. The method, as recited in claim 11, wherein the step (d) comprises a step of applying compressed gas to said melting end of said wire for atomizing and accelerating said coating residues towards said exposure surface of said raw utilizing sheet so as to coat said exposure surface with said coating residues for forming said shielding layer.

13. A method of producing a radiation shield sheet, comprising the steps of:

(a) providing a piece of raw utilizing sheet which has a net structure defining a plurality of trapping meshes therethrough;

(b) providing a predetermined amount of radiation inadmissible materials at a predetermined form of existence, wherein said radiation inadmissible material capable of attenuating an intensity of a predetermined amount of radiation, wherein said step (b) comprises a step of providing a wire, having a melting end, which is made of said predetermined radiation inadmissible materials;

(c) raising the temperature of said radiation inadmissible materials to an extent of melting said radiation inadmissible materials so as to form a predetermined amount of coating residues, wherein said step (c) further comprises the steps of:

(c1') providing a predetermined amount of air and fuel mixed together to form an air-fuel mixture in vicinity of said melting end of said wire; and (c2') igniting said air-fuel mixture to trigger combustion in vicinity of said melting end of said wire so as to sharply increase temperature thereof for melting said melting end to produce said coating residues; and (d) applying said coating residues towards an exposure surface of said raw utilizing sheet so as to coat said exposure surface with said coating residues to form a shielding layer, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer.

14. The method, as recited in claim 13, wherein the step (d) comprises a step of applying compressed gas to said melting end of said wire for atomizing and accelerating said coating residues towards said exposure surface of said raw utilizing sheet so as to coat said exposure surface with said coating residues for forming said shielding layer.

15. A method of producing a radiation shield sheet, comprising the steps of:

(a) providing a piece of raw utilizing sheet which has a net structure defining a plurality of trapping meshes therethrough;

(b) providing a predetermined amount of radiation inadmissible materials at a predetermined form of existence, wherein said radiation inadmissible material capable of attenuating an intensity of a predetermined amount of radiation, wherein said step (b) comprises a step of providing a predetermined amount of said radiation inadmissible materials in powdered form;

(c) raising the temperature of said radiation inadmissible materials to an extent of melting said radiation inadmissible materials so as to form a predetermined amount of coating residues, wherein said step (c) further comprises the steps of:

(c1") providing a plasma of a predetermined inert gas, and arranging said plasma to be flowed between an electrode and a nozzle at a predetermined flow rate; and (c2") applying a predetermined amount of potential difference between said electrode and said nozzle so as to transfer a large amount of energy to said plasma to ionize atoms of said plasma and thus generate a large amount of heat and an immense expansion of the plasma; and (d) applying said coating residues towards an exposure surface of said raw utilizing sheet so as to coat said exposure surface with said coating residues to form a shielding layer, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer.

16. The method, as recited in claim 15, wherein the step (d) further comprises the steps of:

(d1") injecting a predetermined amount of said powder of said radiation inadmissible materials to said expanding plasma such that said radiation inadmissible material in said powdered form is melted by said high temperature plasma to form said coating residues; and (d2") injecting said coating residues towards said exposure surface of said raw utilizing sheet to form said shielding layer.

17. A method of producing a radiation shield sheet, comprising the steps of:

(a) providing a piece of raw utilizing sheet which has a net structure defining a plurality of trapping meshes therethrough;

(b) providing a predetermined amount of radiation inadmissible materials at a predetermined form of existence, wherein said radiation inadmissible material capable of attenuating an intensity of a predetermined amount of radiation, wherein said step (b) comprises a step of providing a predetermined amount of said radiation inadmissible materials in powdered form;

(c) raising the temperature of said radiation inadmissible materials to an extent of melting said radiation inadmissible materials so as to form a predetermined amount of coating residues, wherein said step (c) further comprises the steps of:

(c1'") providing a predetermined amount of carrier gas, and arranging said carrier gas to be mixed with said powdered radiation inadmissible material in a combustion chamber;

(c2'") providing a predetermined amount of air and fuel mixed together to form an air-fuel mixture and directing said mixture to said combustion chamber to mix with said carrier gas and said powdered radiation inadmissible material; and (c3'") igniting said air-fuel mixture and said carrier gas to trigger combustion in said combustion chamber so as to sharply increase temperature of said powdered radiation inadmissible material which is mixed with said carrier gas to melt said radiation inadmissible material to produce said coating residues; and (d) applying said coating residues towards an exposure surface of said raw utilizing sheet so as to coat said exposure surface with said coating residues to form a shielding layer, wherein a portion of said radiation inadmissible material is extended and captured into said trapping meshes to form a plurality of holding roots of the shielding layer so as to support and reinforce a layer of said radiation inadmissible material to be bonded on said raw utilizing sheet to form said shielding layer.

18. The method, as recited in claim 17, wherein the step (d) comprises a step of passing compressed gas to said coating residues for applying said coating residues to said exposure surface of said raw utilizing sheet so as to generate said shielding layer thereon.

* * * * *